US008986179B2

(12) United States Patent
Cares

(10) Patent No.: US 8,986,179 B2
(45) Date of Patent: Mar. 24, 2015

(54) EXERCISE APPARATUS FOR WORKING CORE MUSCLES

(75) Inventor: Louis G. Cares, Grand Rapids, MI (US)

(73) Assignee: P & L Company, L.L.C., Kentwood, MI (US)

( * ) Notice: Subject to any disclaimer, the term of this patent is extended or adjusted under 35 U.S.C. 154(b) by 430 days.

(21) Appl. No.: 13/296,798

(22) Filed: Nov. 15, 2011

(65) Prior Publication Data

US 2012/0122638 A1 May 17, 2012

Related U.S. Application Data

(60) Provisional application No. 61/490,711, filed on May 27, 2011, provisional application No. 61/413,616, filed on Nov. 15, 2010.

(51) Int. Cl.

| | |
|---|---|
| ***A63B 26/00*** | (2006.01) |
| ***A63G 1/00*** | (2006.01) |
| ***A63B 21/002*** | (2006.01) |
| ***A63B 23/02*** | (2006.01) |
| *A63B 21/005* | (2006.01) |
| *A63B 71/06* | (2006.01) |

(52) U.S. Cl.

CPC ..... *A63B 21/0023* (2013.01); *A63B 21/0058* (2013.01); *A63B 23/0205* (2013.01); *A63B 23/0233* (2013.01); *A63B 2071/068* (2013.01); *A63B 2071/0683* (2013.01); *A63B 2220/16* (2013.01); *A63B 2220/805* (2013.01); *A63B 2225/50* (2013.01)

USPC ..... 482/145; 482/142; 482/143; 472/22

(58) Field of Classification Search

CPC ..... A63B 22/02; A63B 2071/025; A63B 22/205; A63B 21/1403; A63B 22/0235; A63B 21/1496; A63B 2208/0252; A63B 69/12; A63B 19/04; A63B 22/0257

USPC ..... 482/4, 7, 23, 43, 51, 55–56, 69, 78, 482/92–96, 98–103, 121–125, 129–143, 482/145–148, 907; 601/24–26, 32, 49–51, 601/52, 56–84, 97–104, 115–132, 136, 601/143–153; 472/16, 18–20, 22, 26, 28, 472/32, 35, 43–47; 434/55

See application file for complete search history.

(56) References Cited

U.S. PATENT DOCUMENTS

| | | | | |
|---|---|---|---|---|
| 3,602,501 | A * | 8/1971 | Garner | 482/145 |
| 4,113,250 | A * | 9/1978 | Davis | 482/144 |
| 4,126,308 | A * | 11/1978 | Crumley | 482/25 |
| 4,391,443 | A * | 7/1983 | Beecroft | 482/145 |
| 4,398,713 | A * | 8/1983 | Ellis | 482/145 |
| 5,800,366 | A * | 9/1998 | Bertrand | 601/24 |
| 6,217,487 | B1 * | 4/2001 | Reinert | 482/54 |
| 6,331,152 | B1 * | 12/2001 | Holle | 482/4 |
| 8,172,736 | B2 * | 5/2012 | Contreras | 482/142 |
| 2005/0011518 | A1 * | 1/2005 | Biondo et al. | 128/204.18 |
| 2006/0019805 | A1 * | 1/2006 | Heck | 482/121 |
| 2009/0299247 | A1 * | 12/2009 | Becerra | 602/32 |

* cited by examiner

*Primary Examiner* — Oren Ginsberg
*Assistant Examiner* — Joshua Lee
(74) *Attorney, Agent, or Firm* — Reising Ethington P.C.

(57) ABSTRACT

An exercise apparatus used to work core muscles such as one's abdomen, obliques, and lower back. The exercise apparatus includes a framework, a leg brace, and a waist support. In some embodiments, the leg brace is motorized, the waist support is motorized, or both the leg brace and the waist support are motorized.

15 Claims, 9 Drawing Sheets

EXERCISE APPARATUS FOR WORKING CORE MUSCLES

CROSS-REFERENCE TO RELATED APPLICATIONS

This application claims the benefit of U.S. Provisional Application No. 61/413,616 filed Nov. 15, 2010, and U.S. Provisional Application No. 61/490,711 filed May 27, 2011, the entire contents of which are hereby incorporated by reference.

TECHNICAL FIELD

The present disclosure relates to exercise equipment used to work core muscles such as one's abdomen, obliques, and lower back.

BACKGROUND OF THE INVENTION

It is believed that the so-called core muscle group has a not insignificant influence on one's posture by helping align parts of a torso such as a spine, ribs, and a pelvis. The core muscle group typically includes muscles of the abdomen, obliques, and lower back. Different exercises and exercise equipment have been developed to work the core muscle group, including what-is-known as the roman chair device in which a user is suspended over the ground surface with a backside of their legs bearing against a support and a frontside of their waist bearing against another support. The user's torso hangs freely over the ground surface and the user bends about their waist for a desired number of repetitions. Roman chair devices are primarily designed to work one's lower back, but can be used to work one's obliques which require the user to partly dismount in order to reposition themselves.

SUMMARY OF THE INVENTION

In accordance with an embodiment of the invention, there is provided an exercise apparatus including a framework, a leg brace, a waist support, and one or more drive mechanism(s). The leg brace is connected to the framework. The waist support is connected to the framework and is located longitudinally away from the leg brace. And the drive mechanism(s) is operatively connected to the leg brace, the waist support, or both the leg brace and the waist support. When the drive mechanism(s) is actuated, the drive mechanism(s) transmits movement to the leg brace, the waist support, or both the leg brace and the waist support. The movement is transferred to a user by way of the leg brace, the waist support, or both the leg brace and the waist support. The user's body is then turned to different exercise positions.

In accordance with another embodiment of the invention, there is provided an exercise apparatus including a framework, a waist support, and a leg brace. The waist support is connected to the framework. The leg brace is connected to the framework and is located longitudinally away from the waist support. The leg brace includes a frame, a drive mechanism, and a leg holder. The frame supports the drive mechanism, and the drive mechanism is operatively connected to the leg holder by way of one or more shaft(s). When the drive mechanism is actuated, the drive mechanism causes rotation of the leg holder by way of the shaft(s). The rotation is transferred to a user, and the user's body is turned to different exercise positions.

In accordance with another embodiment of the invention, there is provided an exercise apparatus including a framework, a leg brace, and a waist support. The framework has a first side frame and a second side frame. The second side frame is located on an opposite side of the framework with respect to the first side frame. The leg brace is connected to the framework. The waist support is connected to the framework and is located longitudinally away from the leg brace. The waist support includes a belt and one or more drive mechanism(s). The belt extends laterally between the first and second side frames. The drive mechanism(s) is interconnected to the belt in order to transmit movement to the belt when the drive mechanism(s) is actuated. In use of the exercise apparatus, legs of a user bear against the leg brace and a waist of the user bears against the belt. Movement of the belt is transferred to the user.

In accordance with another embodiment of the invention, there is provided an exercise apparatus including a framework, a leg brace, and a waist support. The framework has a first side frame and a second side frame. The second side frame is located on an opposite side of the framework with respect to the first side frame. The leg brace is connected to the framework. The waist support is connected to the framework and is located longitudinally away from the leg brace. The waist support includes a first roller, a second roller, and an endless belt. The first roller is connected to the first side frame. The second roller is connected to the second side frame. The endless belt is looped around the first and second rollers, and traverses laterally across the framework between the first and second side frames. In one or more exercise positions, a backside of a user's legs bears against the leg brace and a frontside of the user's waist bears against the endless belt. In this position, a frontside of the user's body is generally directed toward an underlying ground surface.

BRIEF DESCRIPTION OF THE DRAWINGS

A preferred exemplary embodiment of the invention will hereinafter be described in conjunction with the appended drawings, wherein like designation denote like elements, and wherein.

DETAILED DESCRIPTION OF THE PREFERRED EMBODIMENTS

Figure 1:
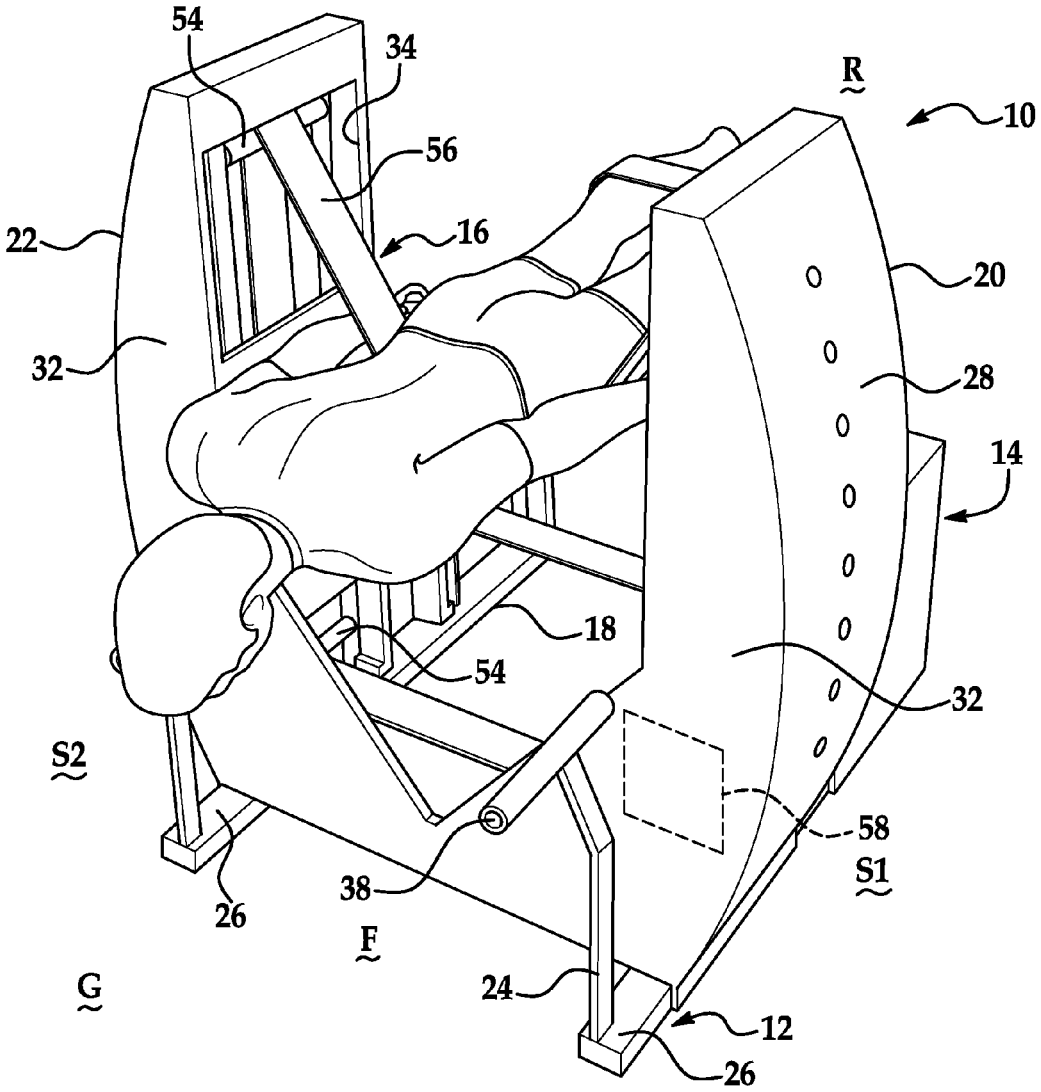
FIG. 1 is a front perspective view of a first embodiment of an exercise apparatus.

Referring to the drawings, FIGS. 1-14 show several illustrative embodiments of an exercise apparatus that is used for exercising one or more core muscles including one's abdomen, obliques, and lower back. When using the exercising apparatuses or equipment shown in the different embodiments, the user is placed in a horizontal position over the ground supported at his or her waist and lower legs, thereby requiring the user to utilize their core muscles to maintain their upper body in the horizontal position. The user can rotate rotisserie-style while in this horizontal position, either manually or by motorized assist; for example, by using a motor-driven waist support belt or by using a motor-driven leg brace. Exercise of the core muscles occurs as a result of the user maintaining the horizontal position during this rotation. Also, the user can separately exercise core muscles at different rotational positions; for example, by rotating the body to different positions and then doing waist bends while at each of those positions. By indexing the body to different rotational positions, whether manually or by motorized assist, the user can isolate or otherwise work at least some of the different core muscles. For example, the motorized waist support or motorized leg brace moves to situate the user in a down position in which the user's frontside faces a ground surface and the lower back can be exercised, in a right-side position in which the user's leftside faces the ground surface and the right oblique can be exercised, in a left-side position in which the user's rightside faces the ground surface and the left oblique can be exercised, and in an up position in which the user's backside faces the ground surface and the abdomen can be exercised. Exercise is also obtained as a result of maintaining the body in the horizontal position during the indexing between rotational positions.

Figure 2:
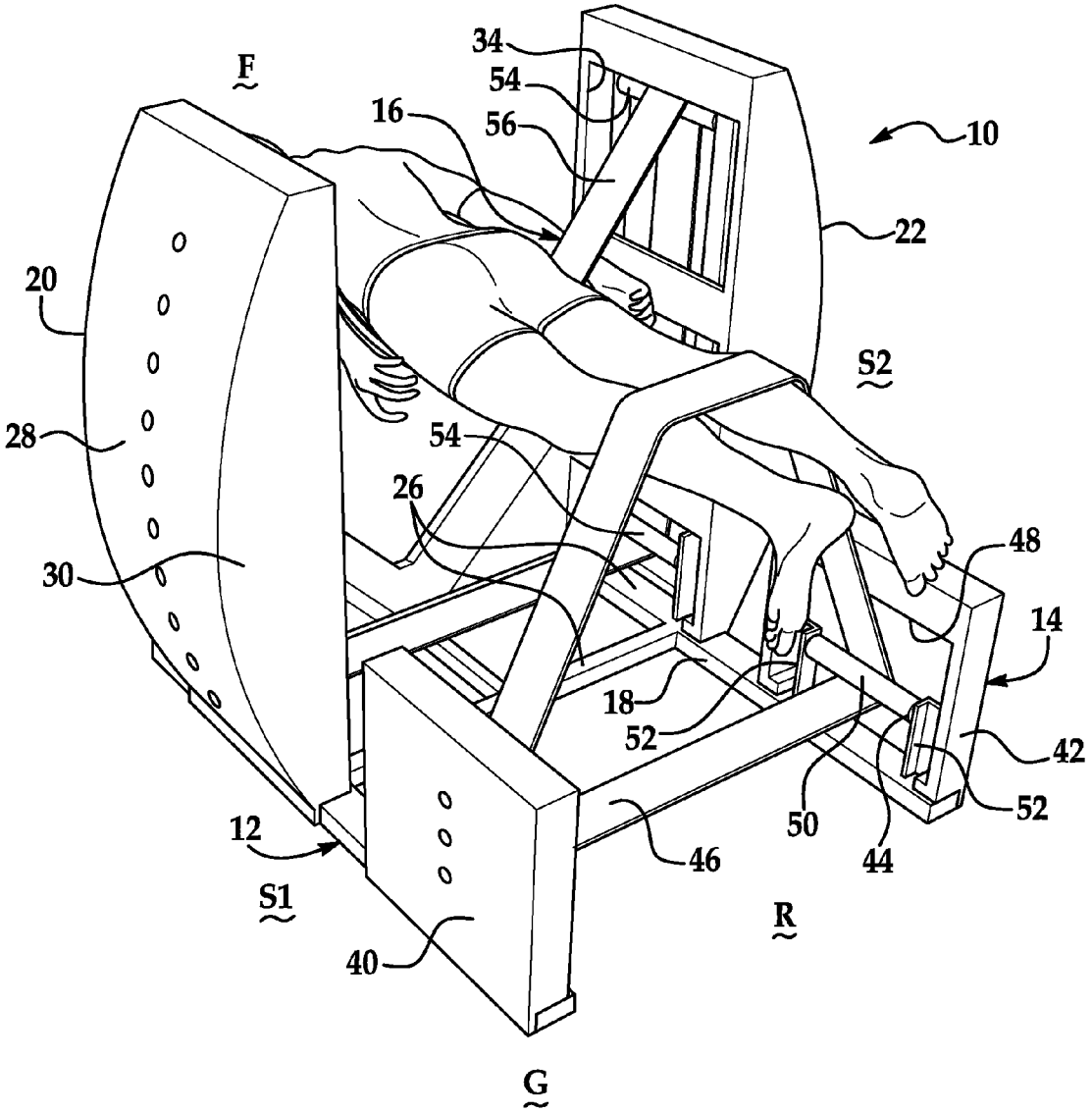
FIG. 2 is a rear perspective view of the exercise apparatus of FIG. 1.

A first illustrative embodiment of an exercise apparatus 10 as shown in FIGS. 1 and 2 includes a framework 12, a leg brace 14, and a waist support 16. The framework 12 provides the structural support for the exercise apparatus 10, and provides connection for a part or more of the leg brace 14 and the waist support 16. In general, the framework 12 has a longitudinal front end F, a longitudinal rear end R, a first lateral side S1, and a second lateral side S2. The ends define a longitudinal direction extending generally between the front end F and rear end R, and the sides define a lateral direction extending generally between the first lateral side S1 and second lateral side S2. Furthermore, the framework 12 can have numerous designs and constructions, including one in which several submembers are separate and distinct and are connected together via welding, fastening, or another way; one in which a one-piece submember has portions providing the needed support and connections of the exercise apparatus 10; or a combination of both of these. Skilled artisans will appreciate that the exact design, construction, and submembers used may be influenced by the need to withstand forces transmitted to the exercise apparatus 10 during use, by ergonomics, by industrial design, and by other factors.

In the example of FIGS. 1 and 2, the framework 12 includes a base frame 18, a first side frame 20, a second side frame 22, and a grip frame 24. The base frame 18 rests directly upon an underlying ground surface G, and includes several base members 26 that extend between one another in both the longitudinal and lateral directions. An individual base member 26 can be an elongated structure and can have a cross-section of rectangular shape, circular shape, L-shape, or another shape. The base members 26 can be composed of a metal material such as steel or aluminum, or a plastic material such as a hard plastic, and can be connected to one another via welding, fastening, or another way. The first side frame 20 is connected to the base frame 18 at the first lateral side S1 of the framework 12, and extends vertically upright therefrom. A part of the waist support 16 is housed in the first side frame 20. In this example, the first side frame 20 is made up of several panels including a side panel 28, a rear panel 30, and a front panel 32. The panels can be composed of a metal material such as steel or aluminum, or a plastic material such as a hard plastic, and can be connected to one another via welding, fastening, or another way. The side panel 28 has an outwardly bowed contour, and the rear and front panels 30, 32 have a generally planar contour. And the first side frame 20 has an opening that is directed laterally inwardly.

The second side frame 22 is connected to the base frame 18 at the second lateral side S2 of the framework 12, and extends vertically upright therefrom. The second side frame 22 is similar in design, construction, and submembers as that of the first side frame 20. Here too, a part of the waist support 16 is housed in the second side frame 22, the second side frame is made up of several panels including a side panel, a rear panel, and the front panel 32, and an opening 34 is directed laterally inwardly. The grip frame 24 is connected to the base frame 18 at the longitudinal front end F of the framework 12, and extends generally vertically upright therefrom. The grip frame 24 provides a support for the user to hold when perching themselves onto the exercise apparatus 10 and getting ready to perform exercises. The grip frame 24 includes a pair of handles 38.

The leg brace 14 holds the user's legs in place while the user is suspended over the ground surface G during use, and helps keep the user balanced and steady on the exercise apparatus 10 while performing exercises. The leg brace 14 can have numerous designs and constructions, including that shown in FIGS. 1 and 2. In these figures, the leg brace 14 includes first and second leg brace frames 40 and 42, roller assemblies 44, and an endless belt 46. The first leg brace frame 40 is connected to the base frame 18 at the first lateral side S1 of the framework 12, and extends vertically upright therefrom. One of the roller assemblies 44 is housed in the first leg brace frame 40. The first leg brace frame 40 can be one-piece or can be made up of several panels connected to one another; the panels can be composed of a metal material such as steel or aluminum, or a plastic material such as a hard plastic. Also, the first leg brace frame 40 has an opening that is directed laterally inwardly. The second leg brace frame 42 is connected to the base frame 18 at the second lateral side S2 of the framework 12, and extends vertically upright therefrom. The second leg brace frame 42 is similar in design, construction, and submembers as that of the first leg brace frame 40. Here too, one of the roller assemblies 44 is housed in the second leg brace frame 42, the second leg brace frame can be one-piece or several panels, and an opening 48 is directed laterally inwardly.

Each of the roller assemblies 44 includes an idle roller 50 that freely spins about an axle connected to a pair of stationary axle members 52. The axle members 52 are connected to the base frame 18 and extend vertically upright therefrom. In another embodiment, the roller assemblies can be designed to spin with some frictional resistance, or need not freely spin at all in which case they merely provide support for the endless belt 46. The endless belt 46 is loosely looped around and anchored at the idle rollers 50, and is moveable thereabout to accommodate the user's legs as they turn and move laterally while performing exercises. The user's legs take up slack and draw the endless belt 46 tight between the idle rollers 50 of the first and second leg brace frames 40, 42. The endless belt 46 extends laterally across the framework 12 and between the first and second leg brace frames 40, 42 so that it can receive the user's legs which are generally directed longitudinally during use. Different flexible materials can be used for the endless belt including high strength fabric, leather, rubber, or another material. In other embodiments, the endless belt can be a belt with a first end fixed-in-place to the first leg brace frame 40 and a second end fixed-in-place to the second leg brace frame 42; here, the belt could be made of a low friction material to accommodate the user's legs as they turn and move while performing exercises.

The waist support 16 holds the user's waist section in place while the user is suspended over the ground surface G during use. The waist support 16 helps keep the user balanced and steady on the exercise apparatus 10 while performing exercises. The waist support 16 can have numerous designs and constructions, including one in which a belt bears directly against the user's waist section and is capable of selective manual or motorized side lateral movement with respect to the user's longitudinal body axis. In the motorized version, the user can turn their body counter to the lateral movement to situate themselves in a position to perform an exercise that is different than the exercise they were performing before the belt moved. For example, in an initial position the user's frontside faces the ground surface G for exercising the lower back muscles. The belt moves toward one side and the user turns their body so that their leftside now faces the ground surface G for exercising the right oblique muscles, while the user is still laterally centered on the belt. These movements and turns can be a part of an automated or manual workout routine in which the user can exercise all of the muscles of the core muscle group consecutively or in any order desired.

In the example of FIGS. 1 and 2, the waist support 16 includes several roller assemblies 54, an endless belt 56, and, optionally, one or more drive mechanisms 58. The roller assemblies 54 support the endless belt 56 and guide movement of the endless belt during use of the exercise apparatus 10. In general, the roller assemblies 54 can be located at various positions of the framework 12 including at the base frame 18 and the first and second side frames 20, 22, and there can be any number of roller assemblies including two or six. In the figures, there are a total of four roller assemblies 54—two located at opposite corners (upper and lower) of the first side frame 20, and two located at opposite corners (upper and lower) of the second side frame 22. The four roller assemblies 54 define different corners of a generally rectangular shape which is outlined by the endless belt 56 when the endless belt is loosely assembled around the roller assemblies. Each of the two roller assemblies 54 at the first side frame 20 include an idle roller that freely spins about an axle connected to a pair of stationary axle members. The axle members are connected to the base frame 18 and extend vertically upright therefrom. Similarly, each of the two roller assembles 54 at the second side frame 22 include an idle roller that freely spins about an axle connected to a pair of stationary axle members. The axle members are connected to the base frame 18 and extend vertically upright therefrom. In another embodiment, the roller assemblies can be designed to spin with some frictional resistance, or need not freely spin at all in which case they merely provide support for the endless belt 56.

The endless belt 56 is somewhat tightly looped around and anchored at the four roller assemblies 54, and is moveable thereabout upon actuation of the drive mechanism. At any movement position, the endless belt 56 has a portion that traverses the vertical extent of the first side frame 20, a portion that traverses the lateral extent adjacent the base frame 18, a portion that traverses the vertical extent of the second side frame 22, and a comparatively more-exposed portion that traverses laterally across the framework 12 adjacent an upper end of, and between, the first and second side frames. The more-exposed portion directly receives and bears against the user's waist section. Different flexible materials can be used for the endless belt including high strength fabric, leather, rubber, or another material. Sides of the endless belt 56 can be coated with, and can be composed of, different materials. For example, the side of the endless belt 56 that makes direct contact with the user can be a material suitable for the contact such as a soft or slightly padded fabric material, while the side of the endless belt that makes contact with the roller assemblies 54 can be a material that generates an acceptable amount of friction with the outer surface of the idle rollers to facilitate movement thereover. In one specific example, the endless belt 56 has a width dimension (i.e., dimension in the longitudinal direction) of about 8½ inches, and has a perimeter length (i.e., its longest dimension) of about 165 inches; of course, other width and length dimensions are possible.

In some embodiments, the endless belt 56 is undriven and only moves along its path around the roller assemblies 54 when caused to do so by the user. In other embodiments, a driver such as the drive mechanism 58 is used. In the illustrated embodiment, the drive mechanism 58 is interconnected to the endless belt 56 and transmits motion to the endless belt upon its actuation, which in turn causes movement of the endless belt. In general, the drive mechanism 58 can be located at various positions of the exercise apparatus 10 including at the base frame 18 and the first and second side frames 20, 22, and can have various interconnections to the endless belt 56 including a direct connection via a rotating shaft of the drive mechanism or an indirect connection via a linkage or gearing assembly cooperating with one or more of the roller assemblies 54. Furthermore, there can be a single drive mechanism transmitting motion in both of the side-to-side lateral directions or only one of the lateral directions, or there can be more than one including a pair of drive mechanisms with one for the first lateral direction and one for the second opposite lateral direction. In the example of FIGS. 1 and 2, the drive mechanism 58 can include a motor such as an electric motor with an armature, commutator, and a spinning shaft. The rotating shaft can be directly connected to the endless belt 56 in order to transmit motion and cause the endless belt to move in both directions back-and-forth. In this example, the drive mechanism 58 can be supported and housed in the first side frame 20 or the second side frame 22. The drive mechanism 58 could be equipped with a power cord for plugging into a power supply, or could be equipped with a battery for the power supply. The drive mechanism 58 can be electrically coupled to an electronic control unit (ECU) that sends command signals to the drive mechanism for directing operation thereof, including turning the drive mechanism on and off. The ECU can include a programmable and readable medium. The command signals sent by the ECU are based on user input at a human-machine-interface (HMI). Different workout routines can be programmed and stored in the HMI and the ECU for selection and execution. Furthermore, in some examples the HMI can be equipped with voice-interaction capabilities that emit audible instructions, information, encouragement, or other sounds to the user before, during, and after a particular workout routine.

In use, the user positions themselves on the exercise apparatus 10 to prepare for exercising one or more muscles of the core muscle group. From an initial standing position longitudinally between the leg brace 14 and the waist support 16 with the body frontside directed toward the waist support, the user leans their body forward so that their waist section meets the more-exposed portion of the endless belt 56. At the same time, the user's legs are placed inside of the initially relaxed endless belt 46 of the leg brace 14. The user holds on to the handles 38 as they lower themselves further forward, their legs rise up off of the ground surface G, and they become suspended off of the ground surface G and over at least a part of the base frame 18. Their upper body and torso hang freely longitudinally beyond the endless belt 56, while their legs are held down by the now tightly-drawn endless belt 46. In this down position, which is that depicted in FIGS. 1 and 2, the user's frontside confronts the ground surface G and the user can bend at their waist to exercise the lower back muscle, or the user can keep their lower back muscles and other muscles tensed and their body straight and plank-like to exercise these muscles.

Once positioned on the apparatus 10, exercise comes primarily in two forms. One is by the use of core muscles to maintain the upper body in the horizontal position, either statically while in the initial position, or dynamically while the body rotates rotisserie-style on the apparatus. Second, individual exercises such as repetitive waist bends can be performed at different, static rotational positions. For example, one possible exercise regimen involves performing three to four revolutions at a speed of about ten seconds per revolution while maintaining the body horizontal and unbent. This is then followed by indexing the body between different static rotational positions, such as eight positions each forty-five degrees apart, and then holding the body steady and/or performing waist bends at each of those positions. To bring themselves to a different position and exercise a different core muscle, the user can manually turn their body about its longitudinal axis unassisted by the motorized waist support (i.e., drive mechanism 58 turned off), or the user can manually turn their body about its longitudinal axis with the assistance of the movement of the endless belt 56 (i.e., drive mechanism 58 turned on). In either case, the user can remain suspended off of the ground surface G and can use the handles 38 to turn their body, though need not. The endless belts 46, 56 facilitate the user's physical actions by accommodating and flexing with the different movements. For assistance by the endless belt 56 and drive mechanism 58, the user can first select a workout routine via the HMI. In one example, the endless belt 56 is actuated and moved at timed intervals; for instance, the endless belt can move in one lateral direction for a predetermined distance and remain stationary for sixty seconds, and then can move in the same lateral direction for another predetermined distance and remain stationary for another sixty seconds. For these time periods, the user can bend at their waist repeatedly, can keep tensed and plank-like, or a combination thereof. And the user can be situated in one of the different positions in each time period, namely the previously-described down position, right-side position, left-side position, and up position.

Figure 3:
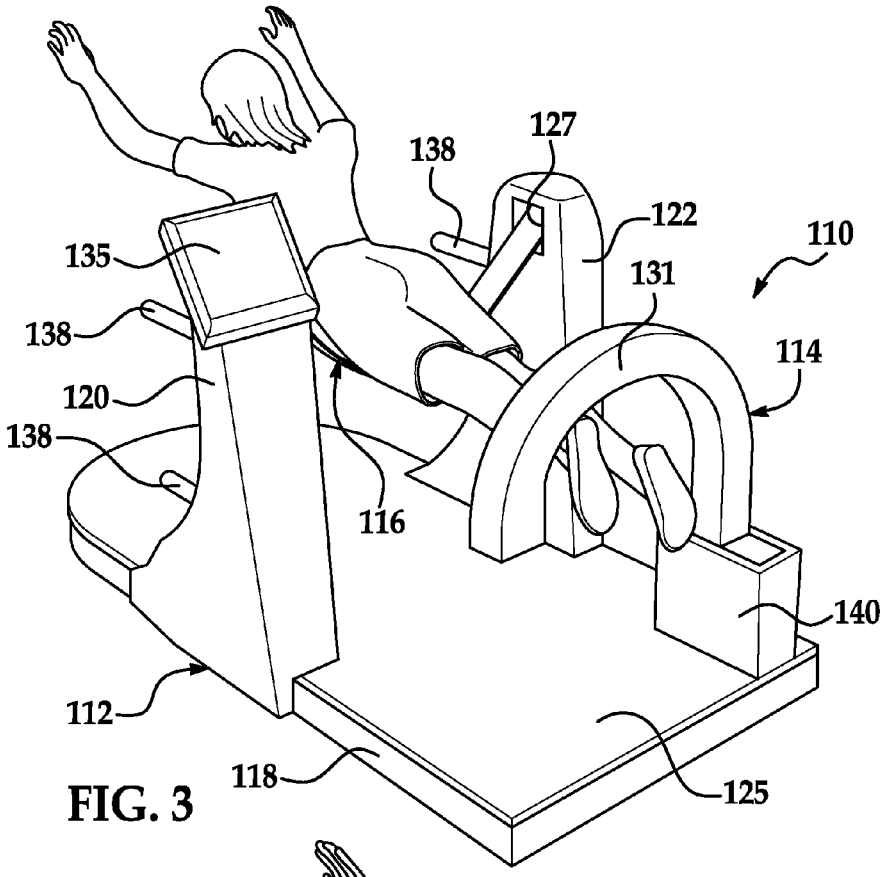
FIG. 3 is a rear perspective view of a second embodiment of an exercise apparatus.
Figure 4:
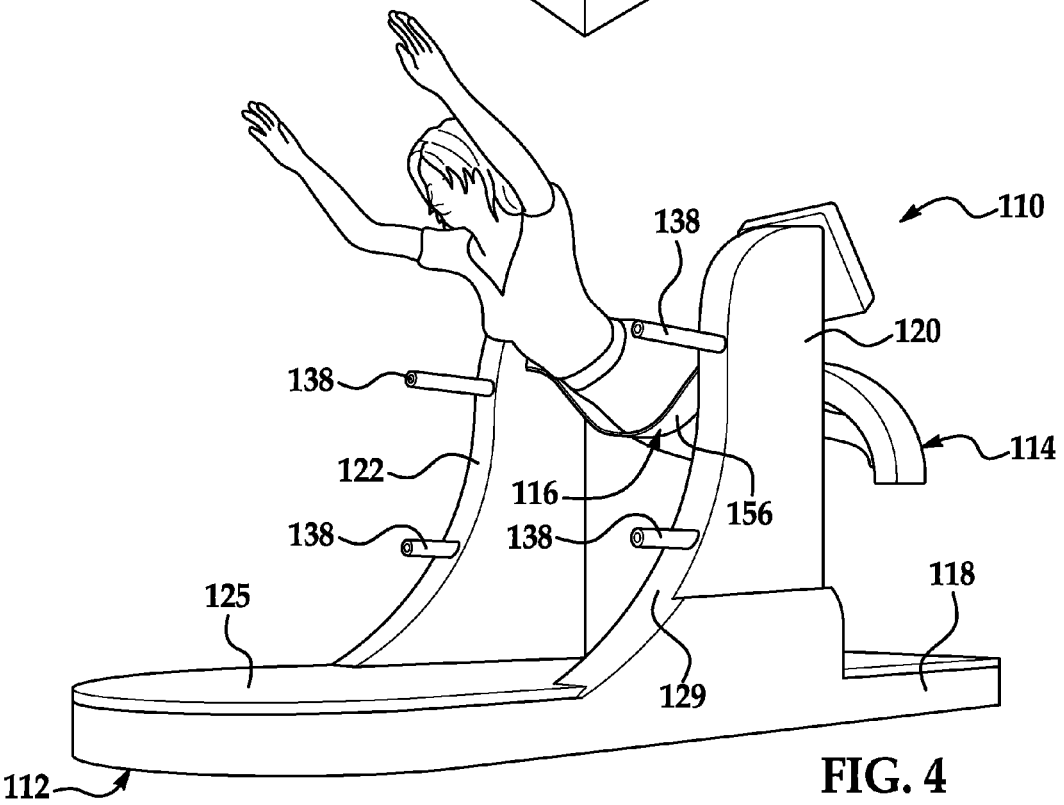
FIG. 4 is a front perspective view of the exercise apparatus of FIG. 3.

A second illustrative embodiment of an exercise apparatus 110 is shown in FIGS. 3 and 4. The exercise apparatus 110 has a similar functionality as the exercise apparatus 10 of FIGS. 1 and 2, and allows performance of the same exercises in a similar way as described. There are some differences, however, in the design, construction, and submembers between the exercise apparatus 10 of FIGS. 1 and 2 and the exercise apparatus 110 of FIGS. 3 and 4. The exercise apparatus 110 includes a framework 112, a leg brace 114, and a waist support 116. The framework 112 includes a base frame 118, a first side frame 120, a second side frame 122, and several handles 138. The base frame 118 has a solid foot platform 125, and the first and second side frames 120, 122 extend vertically upright from the platform and are each mostly closed structures that house a large part of the waist support 116. Each of the first and second side frames 120, 122 have an opening 127 through which a portion of an endless belt 156 of the waist support 116 traverses. The handles 138 project from a front surface 129 of each of the first and second side frames 120, 122.

The leg brace 114 of FIGS. 3 and 4 includes a leg brace frame 140, a rigid member 131, and numerous bearings. The leg brace frame 140 is connected to the base frame 118 and extends vertically upright from the foot platform 125. The rigid member 131 has an elongated arcuate shape that extends from the leg brace frame 140, and has a free end spaced a lateral distance from the leg brace frame and spaced a vertical distance from the foot platform 125—the resulting opening provides room for placing the user's legs in the leg brace 114. The bearings can be carried by the rigid member 131 at its arcuate portion and can be located at an underside of the arcuate portion. The bearings can be slightly protruding from an outer surface thereat in order to make contact with the user's legs when they are placed in the leg brace 114. During use, the bearings facilitate physical movement and turning of the user's legs. In another embodiment, the bearings need not be provided in which case the rigid member's outer surface could be padded and makes contact with the user's legs; also, the bearings could be rollers that are padded for comfort and that are mounted to rotate as the user rotates while switching between different exercises.

The waist support 116 includes several roller assemblies, an endless belt 156, and one or more drive mechanisms. The roller assemblies can be located at various positions of the framework 112 including underneath the foot platform 125 and inside of the first and second side frames 120, 122, and there can be any number of roller assemblies including two, four, or six. Each of the roller assemblies can include an idle roller that freely spins about an axle connected between a pair of stationary members. Furthermore, the roller assemblies can be designed to spin with some frictional resistance, or need not freely spin at all in which case they merely provide support for the endless belt 156. At any movement position the endless belt 156 has a portion that traverses the vertical extent of the first side frame 120, a portion that traverses the lateral extent underneath the foot platform 125, a portion that traverses the vertical extent of the second side frame 122, and a comparatively more-exposed portion that traverses laterally across the framework 112 adjacent an upper end of, and between, the first and second side frames (this is the portion that is visible in FIGS. 3 and 4).

The drive mechanism can be located at various positions of the exercise apparatus 110 including underneath the foot platform 125 and inside of the first and second side frames 120, 122, and can have various interconnections to the endless belt 156 including a direct connection via a rotating shaft of the drive mechanism or an indirect connection via a linkage or gearing assembly cooperating with one or more of the roller assemblies. Furthermore, there can be a single drive mechanism transmitting motion in both of the side-to-side lateral directions or only one of the lateral directions, or there can be more than one including a pair of drive mechanisms with one for the first lateral direction and one for the second opposite lateral direction. The drive mechanism can be electrically coupled to an electronic control unit (ECU) that sends command signals to the drive mechanism for directing operation thereof, including turning the drive mechanism on and off. The command signals sent by the ECU are based on user input at a human-machine-interface (HMI) 135 which is located at an upper end of the first side frame 120. Different workout routines can be programmed in the HMI 135 and the ECU for selection and execution. Furthermore, in some examples the HMI 135 can be equipped with voice-interaction capabilities that emit audible instructions, information, encouragement, or other sounds to the user before, during, and after a particular workout routine.

Figure 5B:
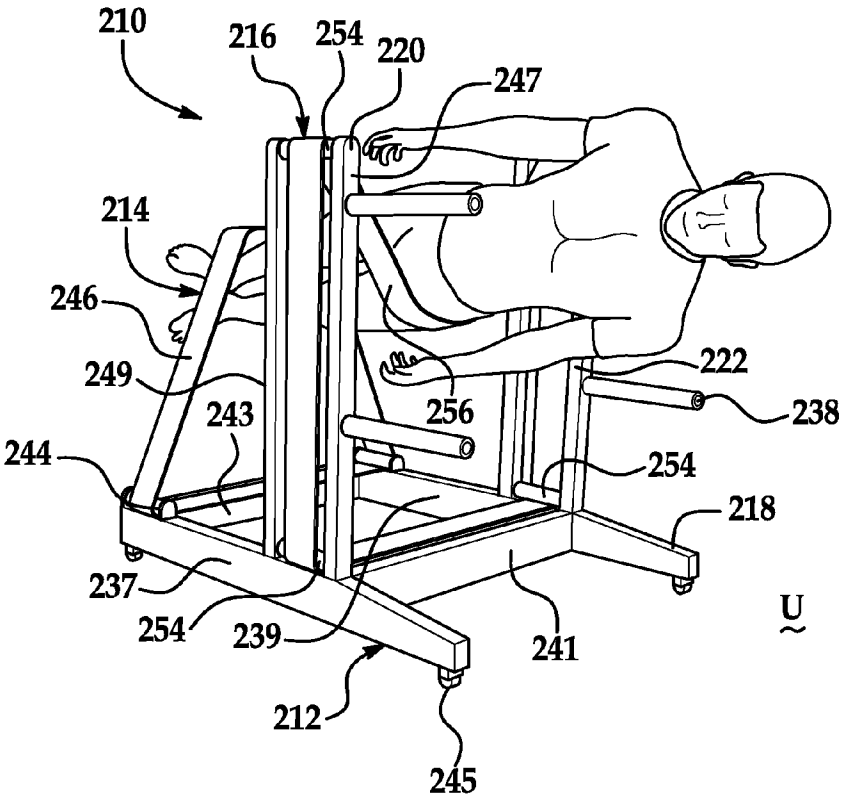
FIG. 5B is a perspective view of the exercise apparatus of FIG. 5A, the exercise apparatus being shown in an uncollapsed configuration.
Figure 5A:
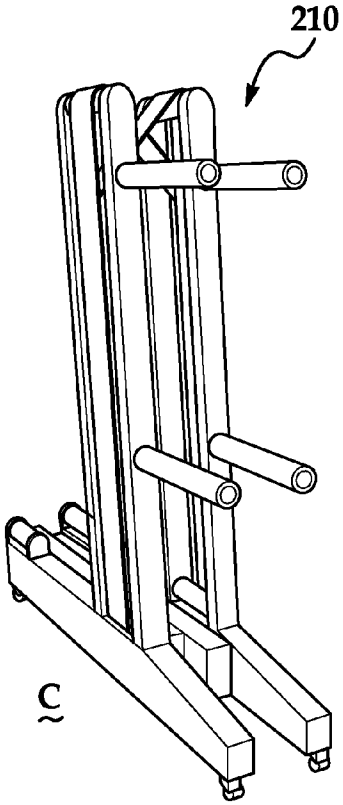
FIG. 5A is a perspective view of a third embodiment of an exercise apparatus, the exercise apparatus being shown in a collapsed configuration.

A third illustrative embodiment of an exercise apparatus 210 is shown in FIGS. 5A and 5B. There are some similarities in the design, construction, and submembers between the exercise apparatuses 10, 110 of FIGS. 1-4 and the exercise apparatus 210 of FIGS. 5A and 5B. There are also some differences, including that the exercise apparatus 210 does not have a motorized waist support. The exercise apparatus 210 includes a framework 212, a leg brace 214, and a waist support 216. The framework 212 includes a base frame 218, a first side frame 220, a second side frame 222, and several handles 238. The base frame 218 is made up of several base members constructed to be collapsed in a general lateral direction so that the exercise apparatus 210 can be stowed during non-use. The base frame 218 includes a first longitudinal base member 237 located at the first lateral side S1, a second longitudinal base member 239 located at the second later side S2, a first lateral base member 241 located near the front end F, and a second lateral base member 243 located near the rear end R. Numerous wheels 245, such as caster wheels, are mounted on a bottom surface of the first and second longitudinal base members 237, 239 for moving the exercise apparatus 210 place-to-place on the ground surface G.

In an uncollapsed configuration U as shown in FIG. 5B, the first and second lateral base members 241, 243 extend laterally across the framework 212 between the first and second longitudinal base members 237, 239. In a stowed or collapsed configuration C as shown in FIG. 5A, the first and second lateral base members 241, 243 are manually folded inwardly—one at a time or simultaneously—against the first and second longitudinal base members 237, 239 and the first and second side frames 220, 222 are stacked closer toward each other. In one example, the first lateral base member 241 is hinged at its intersection with the second longitudinal base member 239, and the second lateral base member 243 is hinged at its intersection with the first longitudinal base member 237. The free end of the first lateral base member 241 opposite its hinged end is unconnected with the first longitudinal base member 237 and simply abuts against the first longitudinal base member in the uncollapsed configuration U. Likewise, the free end of the second lateral base member 243 opposite its hinged end is unconnected with the second longitudinal base member 239 and simply abuts against the second longitudinal base member in the uncollapsed configuration U. In other examples, the framework 212 can be designed and constructed to collapse and uncollapse in different ways; for instance, lateral base members can telescopically collapse within themselves upon release of an interengaging spring-loaded projection and hole, or the base members of the base frame can be hinged, pivoted, or jointed for folding in another way such as collapsing the exercise apparatus in a general longitudinal direction.

The first side frame 220 extends vertically upright from the first longitudinal base member 237, and the second side frame 222 extends vertically upright from the second longitudinal base member 239. Each of the first and second side frames 220, 222 includes first and second side members 247, 249 connected to the respective first and second longitudinal base member 237, 239, and longitudinally spaced a distance away from each other. The handles 238 project from a front surface of the first side members 247 of the first and second side frames 220, 222.

The leg brace 214 of FIG. 5 includes a pair of roller assemblies 244 and an endless belt 246. One of the roller assemblies 244 is connected to the first longitudinal base member 237 at a top surface thereof, and the other of the roller assemblies is connected to the second longitudinal base member 239 at a top surface thereof. Each of the roller assemblies 244 includes an idle roller that freely spins about an axle connected between a pair of stationary members. Furthermore, the roller assemblies 244 can be designed to spin with some frictional resistance, or need not freely spin at all in which case they merely provide support for the endless belt 246. The endless belt 246 is loosely looped around and anchored at the roller assemblies 244, and is moveable thereabout to accommodate the user's legs as they turn and move or remain somewhat stationary while performing exercises.

The waist support 216 includes several roller assemblies 254 and an endless belt 256. Two roller assemblies 254 are located at opposite corners (upper and lower) of the first side frame 220, and two roller assemblies are located at opposite corners (upper and lower) of the second side frame 222. The roller assemblies 254 at the first side frame 220 are connected between the first and second side members 247, 249 thereof, and likewise the roller assemblies at the second side frame 222 are connected between the first and second side members thereof. Each of the roller assemblies 254 includes an idle roller that freely spins about an axle connected between the respective first and second side members 247, 249. Furthermore, the roller assemblies 254 can be designed to spin with some frictional resistance, or need not freely spin at all in which case they merely provide support for the endless belt 256. The endless belt 256 is somewhat tightly looped around and anchored at the four roller assemblies 254, and is moveable thereabout upon manual actuation. At any movement position, the endless belt 256 has a portion that traverses the vertical extent of the first side frame 220, a portion that traverses the lateral extent adjacent the base frame 218, a portion that traverses the vertical extent of the second side frame 222, and a portion that traverses laterally across the framework 212 adjacent an upper end of, and between, the first and second side frames.

In use, to exercise by rotation or to bring themselves to a different position and exercise a different core muscle, the user can manually turn their body about its longitudinal axis. The user can remain suspended off of the ground surface G and can use the handles 238 to physically turn their body. The endless belts 246, 256 facilitate the user's physical actions by accommodating and flexing with the different movements. At the end of each turn, the user is kept generally laterally centered on the endless belt 256 by the movement of the endless belt over the four roller assemblies 254—the endless belt can be displaced simultaneously with, and by an equal distance as, the turning of the user's body.

Figure 6:
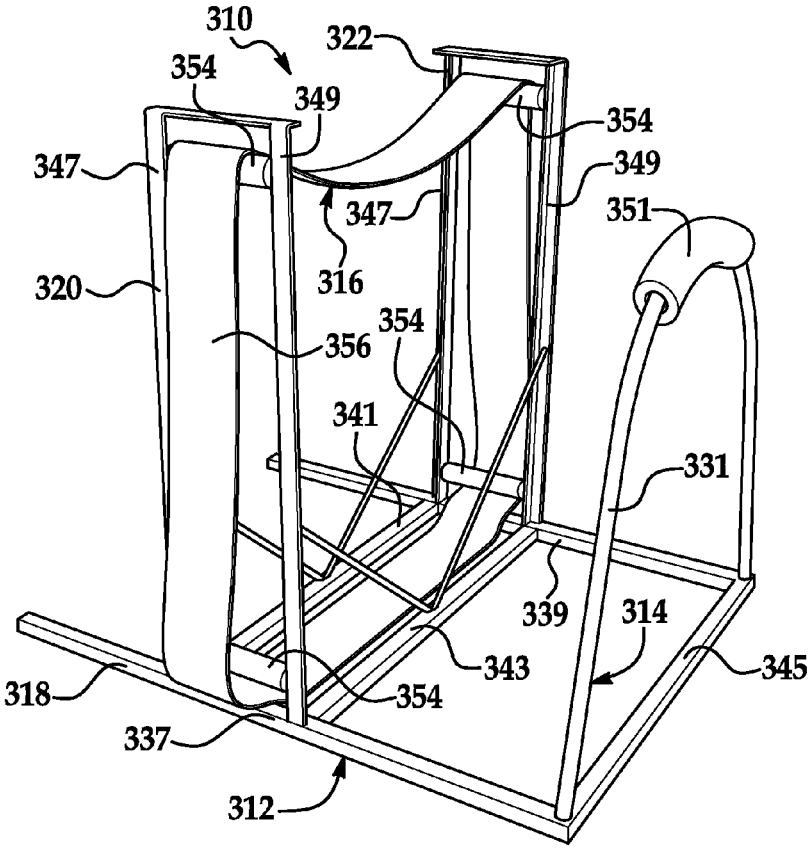
FIG. 6 is a perspective view of a fourth embodiment of an exercise apparatus.

A fourth illustrative embodiment of an exercise apparatus 310 is shown in FIG. 6. There are some similarities in the design, construction, and submembers between the exercise apparatuses 10, 110, 210 of FIGS. 1-5B and the exercise apparatus 310 of FIG. 6. There are also some differences, including that the exercise apparatus 310 does not have a motorized waist support. The exercise apparatus 310 includes a framework 312, a leg brace 314, and a waist support 316. The framework 312 includes a base frame 318, a first side frame 320, and a second side frame 322. The base frame 318 is made up of several base members including a first longitudinal base member 337 located at the first lateral side S1, a second longitudinal base member 339 located at the second lateral side S2, a first lateral base member 341, a second lateral base member 343, and a third lateral base member 345. The first side frame 320 extends vertically upright from the first longitudinal base member 337, and the second side frame 322 extends vertically upright from the second longitudinal base member 339. Each of the first and second side frames 320, 322 includes first and second side members 347, 349 connected to a respective first and second longitudinal base member 337, 339, and longitudinally spaced a distance away from each other.

The leg brace 314 of FIG. 6 includes a rigid member 331 and numerous bearings. The rigid member 331 has an arcuate shape that extends from, and is connected between, the first and second longitudinal base members 337, 339. A leg pad 351, which can be made of foam, is wrapped around a portion of the rigid member 331 at about a lateral center position thereof, and has a lateral dimension coextensive with the expected lateral movement of the user's legs while performing exercises. The bearings can be carried by the rigid member 331 or by the leg pad 351, and can be located at an underside thereof. The bearings can be slightly protruding from an immediately surrounding outer surface in order to make contact with the user's legs when they are placed in the leg brace 314. During use, the bearings facilitate physical movement and turning of the user's legs. In another embodiment, the bearings need not be provided in which case the leg pad 351 makes contact with the user's legs.

The waist support 316 includes several roller assemblies 354 and an endless belt 356. Two roller assemblies 354 are located at opposite corners (upper and lower) of the first side frame 320, and two roller assemblies are located at opposite corners (upper and lower) of the second side frame 322. The roller assemblies 354 at the first side frame 320 are connected between the first and second side members 347, 349 thereof, and likewise the roller assemblies at the second side frame 322 are connected between the first and second side members thereof. Each of the roller assemblies 354 includes an idle roller that freely spins about an axle connected between the respective first and second side members 347, 349. Furthermore, the roller assemblies 354 can be designed to spin with some frictional resistance, or need not freely spin at all in which case they merely provide support for the endless belt 356. The endless belt 356 is somewhat tightly looped around and anchored at the four roller assemblies 354, and is moveable thereabout upon manual actuation. At any movement position, the endless belt 356 has a portion that traverses the vertical extent of the first side frame 320, a portion that traverses the lateral extent adjacent the base frame 318, a portion that traverses the vertical extent of the second side frame 322, and a portion that traverses laterally across the framework 312 adjacent an upper end of, and between, the first and second side frames.

Figure 7:
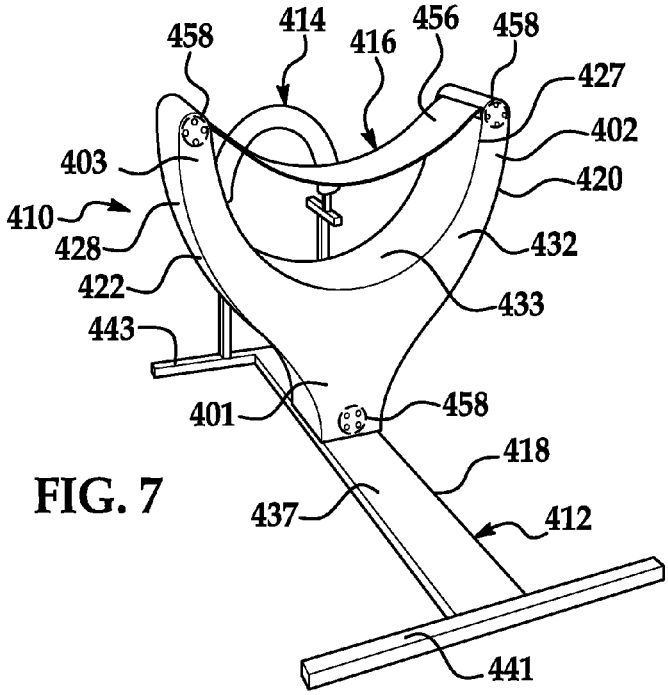
FIG. 7 is a perspective view of a fifth embodiment of an exercise apparatus.
Figure 8:
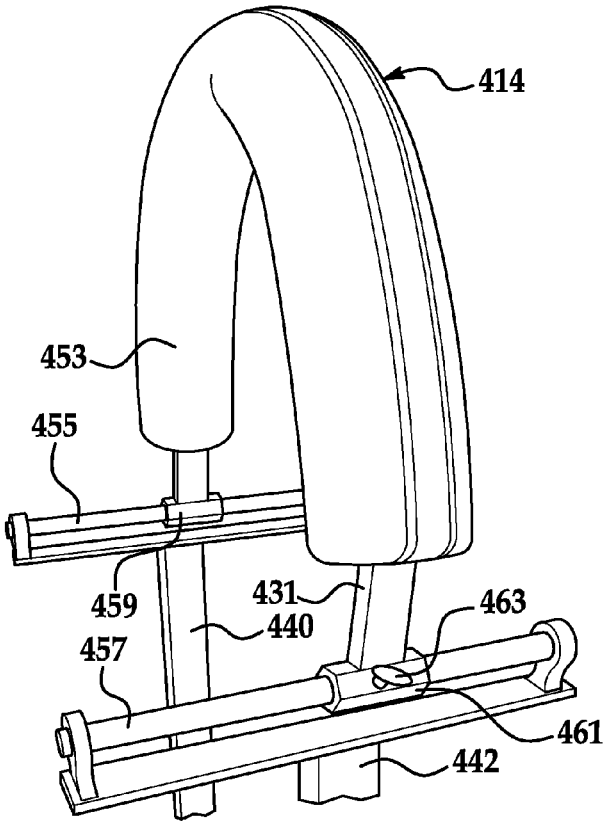
FIG. 8 is a perspective view of an embodiment of a leg brace that can be equipped with the exercise apparatus of FIG. 7.
Figure 9:
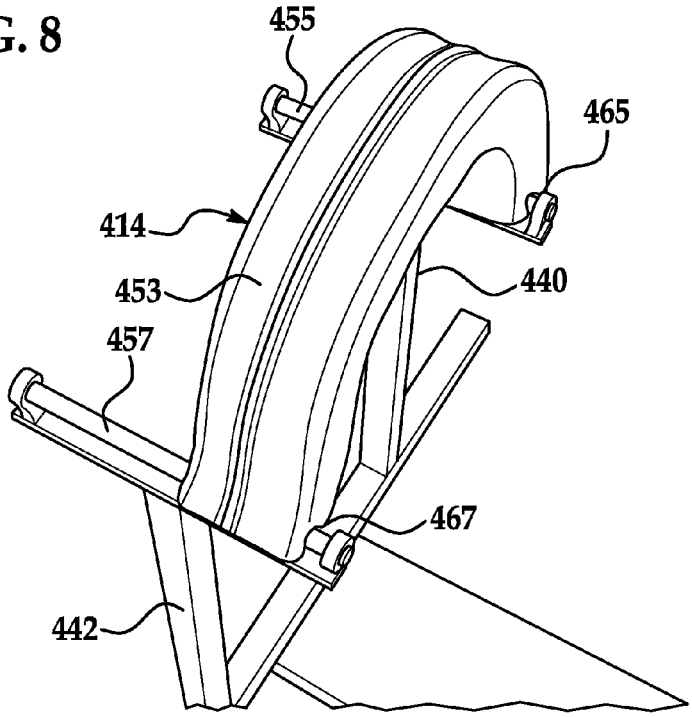
FIG. 9 is a perspective view of an embodiment of a leg brace that can be equipped with the exercise apparatus of FIG. 7.

A fifth illustrative embodiment of an exercise apparatus 410 is shown in FIGS. 7-9. There are some similarities in the design, construction, and submembers between the exercise apparatuses 10, 110, 210, 310 of FIGS. 1-6 and the exercise apparatus 410 of FIGS. 7-9. The exercise apparatus 410 includes a framework 412, a leg brace 414, and a waist support 416. The framework 412 includes a base frame 418, a first side frame 420, and a second side frame 422. The base frame 418 is made up of several base members including a longitudinal base member 437, a first lateral base member 441, and a second lateral base member 443.

The first side frame 420 extends vertically upright from the base frame 418 and is connected thereto. The first side frame 420 is made up of several panels including a side panel, a rear panel, and a front panel 432. The panels can be composed of a metal material such as steel or aluminum, and can be connected to one another via welding, fastening, or another way. Similarly, the second side frame 422 extends vertically upright from the base frame 418 and is connected thereto. The second side frame 422 is made up of several panels including a side panel 428, the rear panel, and the front panel 432. Again, the panels can be composed of a metal material such as steel or aluminum, and can be connected to one another via welding, fastening, or another way. Furthermore, a curved top panel 433 extends longitudinally between the rear panel and the front panel 432; and each of the first and second side frames 420, 422 has an opening 427 through which a portion of an endless belt 456 of the waist support 416 traverses during use of the exercise apparatus 410. As shown in this embodiment, the panels form a substantially enclosed and hollow structure that houses parts of the waist support 416. The substantially enclosed structure has a generally wishbone or Y-shape with a stem portion 401, a first prong portion 402, and a second prong portion 403. And though not shown, handles could be provided and could project from the front panel 432.

The leg brace 414 includes a first leg brace frame 440, a second leg brace frame 442, and optionally includes a rigid member 431. The first and second leg brace frames 440, 442 are connected to the base frame 418 and extend vertically upright therefrom; in particular, the first and second leg brace frames extend vertically upright from the second lateral base member 443. The rigid member 431 has an elongated arcuate shape, and carries a leg pad therearound for contact with the user's legs during use of the exercise apparatus 410. The leg pad can be made of foam or another padding material. Though not specifically shown, the leg pad in FIG. 8 has a cross-sectional profile in the general shape of an open ring, and the leg pad in FIG. 9 has a cross-sectional profile in the general shape of a rectangle. To keep the leg pad held to the rigid member 431, a cover 453 is wrapped around the padding part of the leg pad and can be zipped, velcroed, or otherwise closed. In other embodiments, the cover 453 need not be openable and closeable, and instead the leg pad can simply be squeezed over the rigid member 431 for a force-fit therearound. And still in other embodiments, the rigid member need not be provided, and instead the leg pad extends between the first and second leg brace frames 440, 442 without the support of a skeletal member.

Referring particularly to FIGS. 8 and 9, the leg brace 414 also includes a longitudinal adjustment assembly to accommodate users of different height and different leg lengths. The longitudinal adjustment assembly is used to slide the leg pad in the fore, or forward, longitudinal direction for users of shorter height, and to slide the leg pad in the aft, or rearward, longitudinal direction for users of taller height. In the example of FIG. 8, the longitudinal adjustment assembly includes a first rail 455 and a second rail 457. The first rail 455 is connected to the first leg brace frame 440, and the second rail 457 is connected to the second leg brace frame 442. The rigid member 431 has a first slide 459 carried by the first rail 455, and has a second slide 461 carried by the second rail 457. Each slide 459, 461 has a thumb screw 463 that can be loosened to permit longitudinal movement of the slide along the respective rail, and that can be tightened-down to fix the desired longitudinal position of the respective slide. In the example of FIG. 8, the first and second slides 459, 461 are in the form of a sleeve-like structure that receives the respective first and second rail 455, 457. In the example of FIG. 9, the longitudinal adjustment assembly also includes the first rail 455 and the second rail 457 connected respectively to the first leg brace frame 440 and the second leg brace frame 442. In this example, however, ends of the leg pad constitute the slides to provide longitudinal movement along the respective rail. A first slide 465 is provided by a portion of the leg pad received around the first rail 455, and a second slide 467 is provided by a portion of the leg pad received around the second rail 457. The portion of the leg pad can be a strap wrapped around the respective rail and velcroed in order to form the respective slide.

In the fifth illustrative embodiment of FIGS. 7-9, the waist support 416 includes the endless belt 456 and three drive mechanisms 458. The endless belt 456 is looped around, and supported by, the drive mechanisms 458. At any one time, the endless belt 456 has a portion located outside of the framework 412 for receiving the user's waist section, and has a comparatively larger portion located inside of the enclosed framework. In one example, the endless belt 456 can be supplied by Mol Belting Systems Inc., of Grand Rapids, Mich. United States; in other examples, other companies can supply the endless belt. The endless belt 456 can have a structure on its underside that interacts with a complementary structure provided on roller assemblies or drive mechanisms in order to facilitate the movement and guidance of the endless belt. For example, the complementary structures of the endless belt and the roller assemblies and/or drive mechanisms could provide a dovetail joint, or the complementary structures could provide a mating male and female groove joint. Furthermore, to facilitate movement and guidance of the endless belt 456, guidance structures can be located adjacent the drive mechanisms 458.

The three drive mechanisms 458 are located at ends of the wishbone shaped enclosed part of the framework 412. In particular, a first drive mechanism 458 is located inside of the first prong portion 402 adjacent the opening 427, a second drive mechanism 458 is located inside of the second prong portion 403 adjacent the opening 427, and a third drive mechanism 458 is located inside of the stem portion 401. In one example, the drive mechanisms 458 can be roller assemblies with a built-in motor such as an electric motor. In another example, one or more of the drive mechanisms 458 of FIG. 7 is instead an idle roller assembly that is not motorized; and in yet another example, all of the drive mechanisms 458 of FIG. 7 are idle roller assemblies and the exercise apparatus 410 is not electrically operated.

A sixth illustrative embodiment of an exercise apparatus 510 is shown in FIGS. 10-14. There are some similarities in the design, construction, and submembers between the exercise apparatuses 10, 110, 210, 310, 410 of FIGS. 1-9 and the exercise apparatus 510 of FIGS. 10-14. The exercise apparatus 510 includes a framework 512, a leg brace 514, and a waist support 516. The framework 512 can have numerous designs and constructions, including that shown in FIG. 10. In this figure, the framework 512 includes a base frame 518, a first side frame 520, and a second side frame 522. The base frame 518 is made up of several base members including longitudinal base members 537 and lateral base members 541. The base frame 518 also includes a solid foot platform 525.

The first side frame 520 extends vertically upright from the base frame 518 and is connected thereto. The first side frame 520 is made up of several panels including a side panel 519, a rear panel 523, and a front panel. The panels can be composed of a metal material such as steel or aluminum, and can be connected to one another via welding, fastening, or another way. Similarly, the second side frame 522 extends vertically upright from the base frame 518 and is connected thereto. The second side frame 522 is made up of several panels including a side panel 521, the rear panel 523, and the front panel. Again, the panels can be composed of a metal material such as steel or aluminum, and can be connected to one another via welding, fastening, or another way. Furthermore, a curved top panel 533 extends longitudinally between the rear panel 523 and the front panel. As shown in this embodiment, the panels form a substantially closed and hollow structure that has a generally wishbone or Y-shape with a stem portion 501, a first prong portion 502, and a second prong portion 503. Handles could be provided and could project from the front panel.

Figure 10:
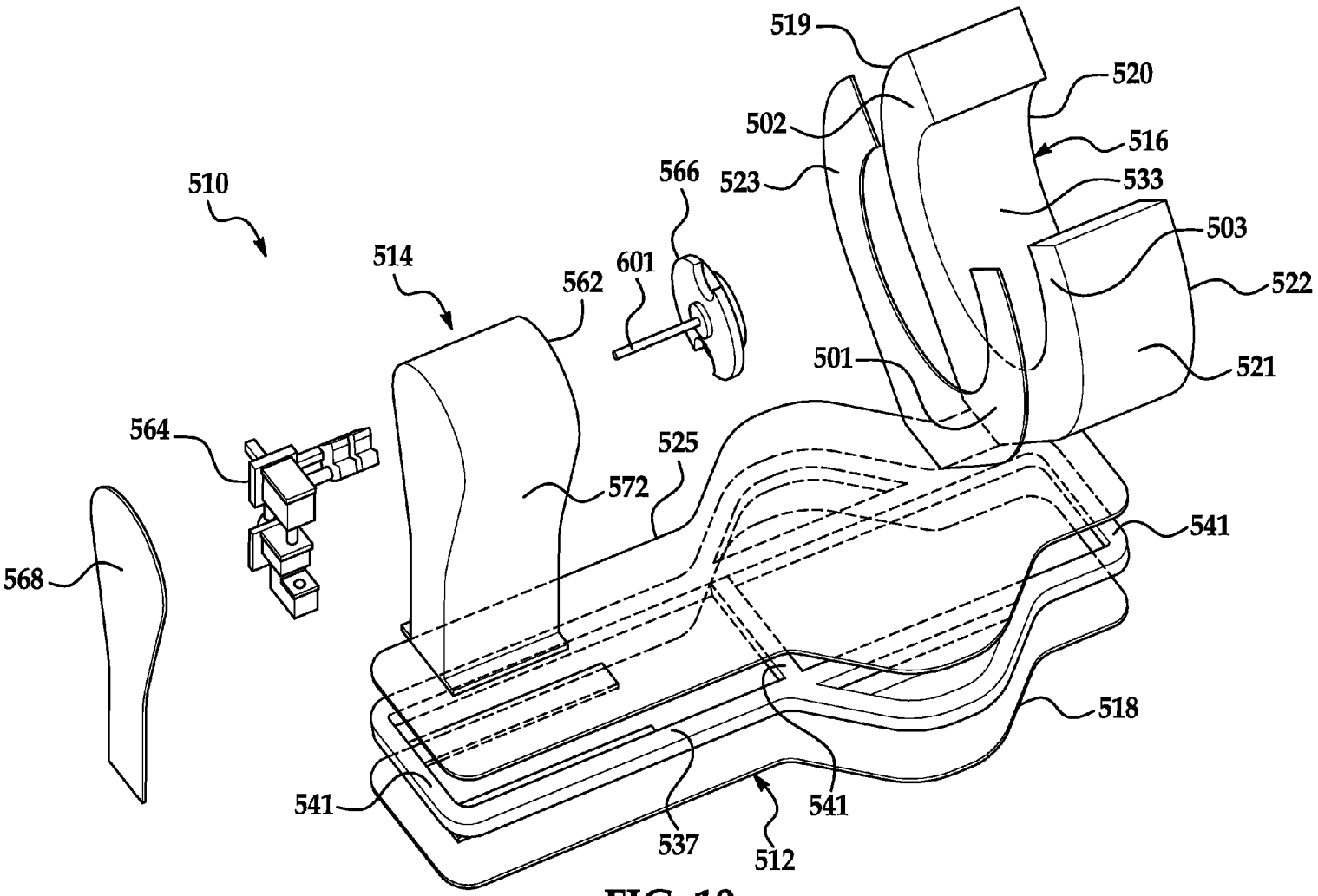
FIG. 10 is a partially exploded view of a sixth embodiment of an exercise apparatus.
Figure 11:
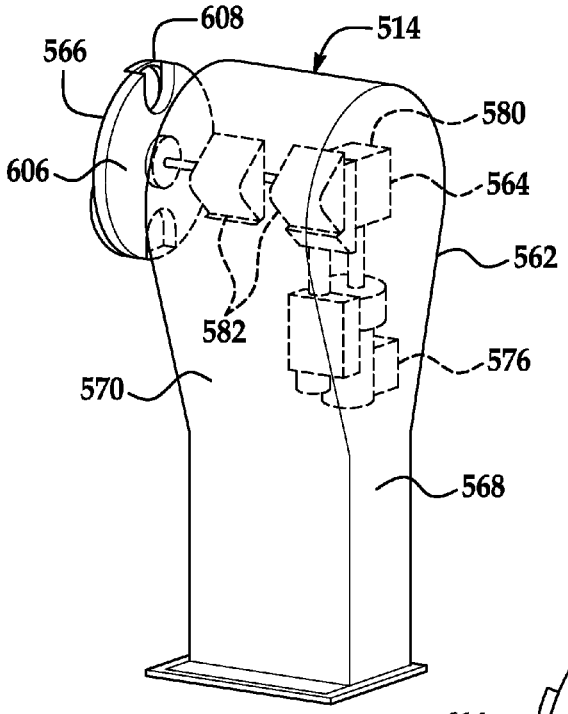
FIG. 11 is a perspective view of an embodiment of a leg brace that can be equipped with the exercise apparatus of FIG. 10.

In this embodiment, the leg brace 514 is motorized to turn the user's body to different rotational positions so that the user can exercise their core muscles. The user's body turns similarly as in previous embodiments with the motorized waist support. The motorized leg brace 514 can have numerous designs and constructions, including that shown in FIGS. 10-14. In these figures, the leg brace 514 includes a leg brace frame 562, a driver, and a leg holder 566. In general, the leg brace frame 562 houses and supports other components of the leg brace 514. Referring to FIGS. 10 and 11, the leg brace frame 562 is connected to the base frame 518, and extends vertically upright from the foot platform 525. Several panels that are connected to one another make up the leg brace frame 562, including a front panel, a rear panel 568, a first side panel 570, and a second side panel 572. Together, the panels enclose the driver. The panels can be composed of a metal material such as steel or aluminum, and can be connected to one another via welding, fastening, or another way. The leg brace frame 562 could also include one or more frame members connected to one another and optionally connected to the panels, via welding, fastening, or another way.

The driver transmits rotational motion to the leg holder 566 upon actuation of the driver. The driver can have numerous designs and constructions including that shown in FIGS. 10-12. In these figures, the driver is enclosed mostly inside of the leg brace frame 562 so that its moving parts are not exposed to the user of the exercise apparatus 510. The driver is connected to the leg holder 566 so that it causes rotary movement thereof. In this embodiment, the driver is a drive mechanism 564, and includes a support frame 574, a motor 576, a clutch 578, a gear box 580, and a pair of trunnion blocks 582. The support frame 574 can be connected to the base frame 518, can be connected to the leg brace frame 562, or can be connected to both. The support frame 574 includes several frame members 584, and includes several mount plates 586 for securing the other components of the driver. The motor 576 can be an electric motor with an armature, commutator, and a spinning shaft 588. The shaft 588 can be directly connected to the clutch 578 or to the gear box 580, depending on the arrangement of the components as described below.

Figure 12:
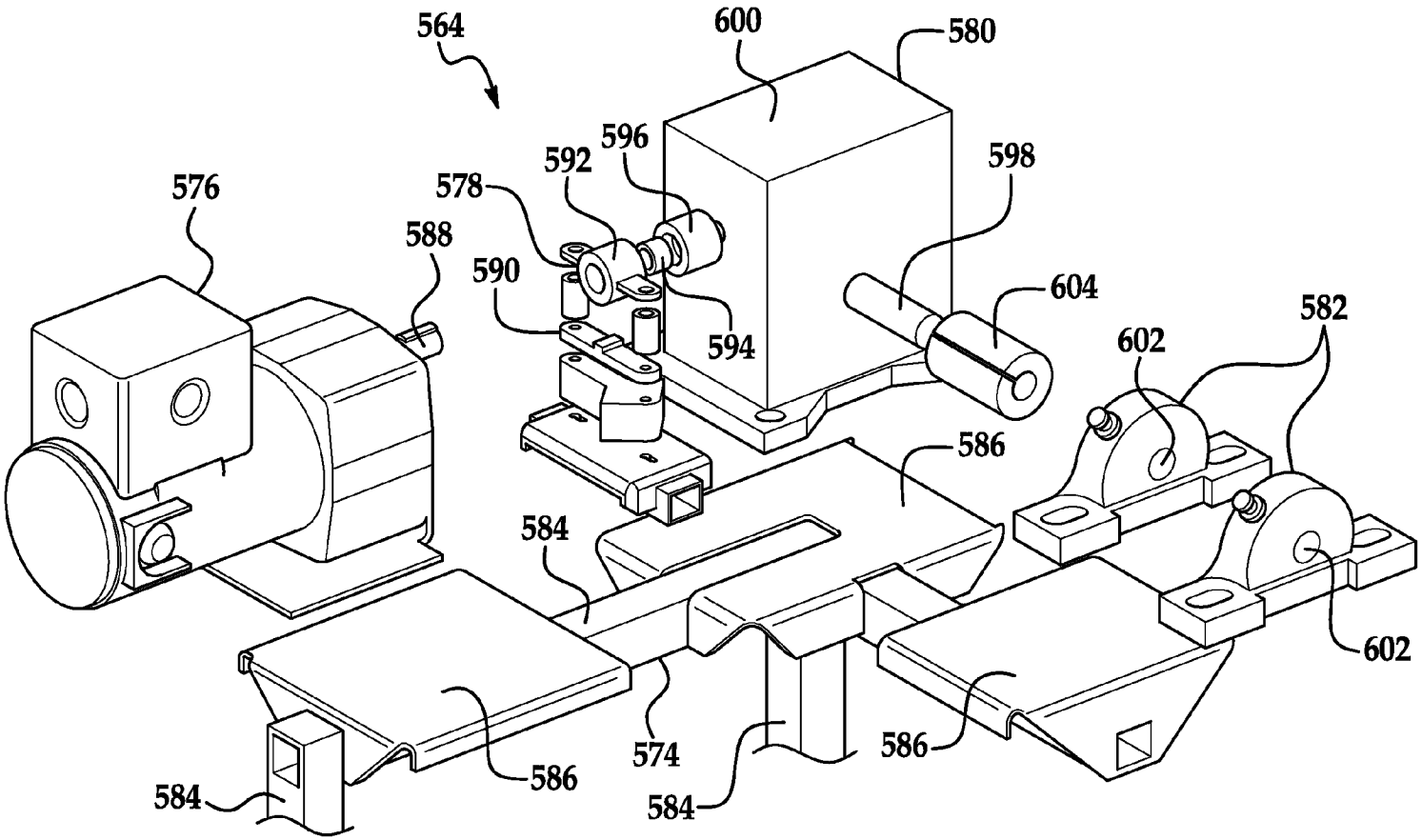
FIG. 12 is an exploded view of an embodiment of a driver that can be a part of the leg brace of FIG. 11.

The clutch 578 selectively transmits motion between its input and output—and thus between a component connected to the input and another component connected to the output—upon engagement and disengagement of the clutch. The clutch 578 can have numerous designs and constructions, including that shown in FIG. 12. In FIG. 12, the clutch 578 is located and interconnected between the motor 576 and the gear box 580 with the clutch's input operatively associated with the motor and the clutch's output operatively associated with the gear box; in other embodiments, the clutch can be located and interconnected between the gear box and the leg holder 566 with the clutch's input operatively associated with the gear box and the clutch's output operatively associated with the leg holder. In these locations, and in general, the clutch's input rotates and axially slides toward the output for engagement therewith and co-rotation therebetween; the component operatively associated with the output then itself is caused to rotate. In the particular embodiment of FIG. 12, the clutch 578 includes a slider 590, a first rotator 592, and a second rotator 594. The slider 590 brings the first and second rotators 592, 594 axially together and axially apart upon engagement and disengagement. The first rotator 592 rotates with the shaft 588 of the motor 576, and has a set of teeth for interlocking with a structurally complementary set of teeth of the second rotator 594. And, the second rotator 594 rotates with an input shaft 596 of the gear box 580. During use, when engaged and interlocked, the clutch 578 causes the shaft 588 of the motor 576 and the input shaft 496 of the gear box 580 to spin together. Conversely, when disengaged and not interlocked, the shaft 588 of the motor 576 and the input shaft 496 of the gear box 580 spin freely with respect to each other. In another embodiment, for example, the clutch 578 could include friction discs that engage each other instead of the interlocking teeth.

The gear box 580 provides speed and torque conversions between the input shaft 596 and an output shaft 598 that are suitable for transferring rotational movement to the user. The gear box 580 can have numerous designs and constructions, including that shown in FIG. 12 and described here. A gear assembly, or gear train, with numerous individual gears is enclosed within a housing 600. One gear can be connected to the input shaft 596 and rotates therewith, and another gear can be connected to the output shaft 598 and rotates therewith. The input gear can engage one or more other individual gears which can in turn engage the output gear in order to, for example, decrease the speed and increase the torque from that at the input shaft 596 to that at the output shaft 598, and therefore decrease the speed and increase the torque from the motor 576 and to the leg holder 566.

The trunnion blocks 582 can support and facilitate rotation of the output shaft 598 of the gear box 580, or can support and facilitate rotation of a shaft 601 of the leg holder 566. Still referring to FIG. 12, the trunnion blocks 582 could each have a bore 602, and a bushing could be fit within each of the bores. A sleeve 604 can be provided to facilitate interconnection between the shafts of the gear box 580 and the leg holder 566.

Figure 13:
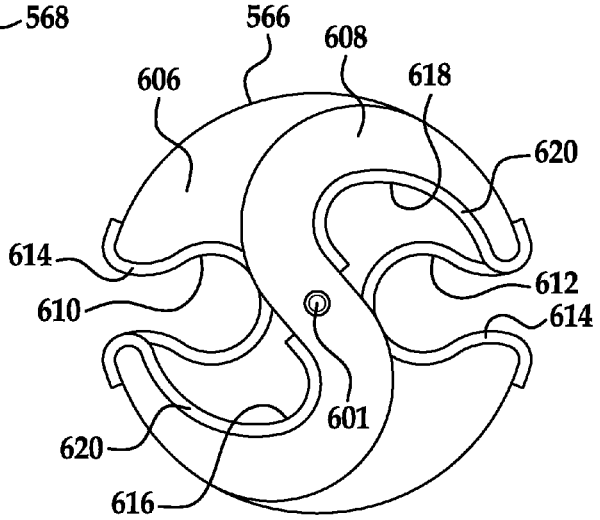
FIG. 13 is a front view of an embodiment of a leg holder that can be equipped with the exercise apparatus of FIG. 10, the leg holder being shown in an open position.
Figure 14:
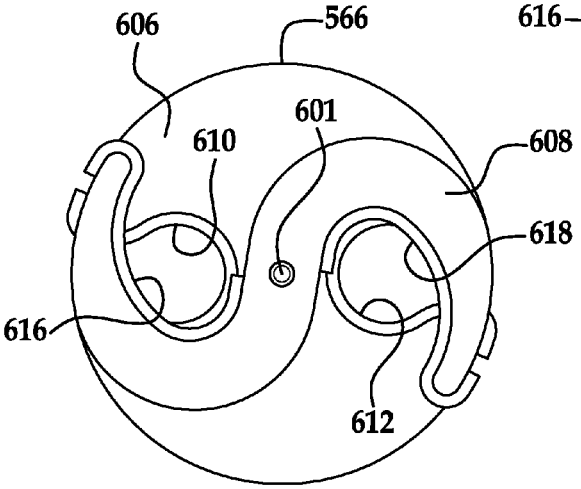
FIG. 14 is a front view of the leg holder of FIG. 13, the leg holder being shown in a closed position.

The leg holder 566 is used to clench the user's legs for turning the user's body during use of the exercise apparatus 510. The leg holder 566 can have numerous designs and constructions, including that shown in FIGS. 13 and 14. As shown in these figures, the leg holder 566 is located outside of the leg brace frame 562 and is spaced a distance from the front panel of the leg brace frame 562 in order to accommodate the user's feet positioned between the front panel and the leg holder 566. The shaft 601 of the leg holder 566 can be connected to the output shaft 598 of the gear box 580 for co-rotation therewith, or can otherwise be operatively associated with the output shaft of the gear box for co-rotation therewith. In this embodiment, the leg holder 566 includes a first clasp 606 and a second clasp 608. The first clasp 606 has a generally disc-shape, and defines a first recess 610 for receiving one leg and a second recess 612 for receiving the other leg of the user. A pad 614 can be fitted around the periphery of each of the first and second recesses 610, 612 for comfortably gripping the user's legs. The second clasp 608 has a generally S-shape, and defines a first recess 616 for receiving the one leg and a second recess 618 for receiving the other leg. Similar to the first clasp 606, a pad 620 can be fitted around the periphery of each of the first and second recesses 616, 618 for comfortably gripping the user's legs. In FIG. 13, the leg holder 566 is shown in an open position to receive and release the user's legs, and in FIG. 14, the leg holder is shown in a closed position to secure the user's legs during rotation and turning thereof. To go from the open to closed position, the second clasp 608 rotates clockwise in FIG. 13 to the angular position shown in FIG. 14 while the first clasp 606 remains stationary. The second clasp 608 can then be locked in this position relative to the first clasp 606, and rotation of the first and second clasps can be fixed relative to each other for co-rotation with each other during use of the exercise apparatus 510. The closing and opening actions can be automated, as described below.

Though not shown, the waist support 516 can include an endless belt and idle rollers for supporting the endless belt, as described in earlier embodiments. In another embodiment, the waist support can simply include padding located on the curved top panel 533.

As described in earlier embodiments, the exercise apparatus 510 can be designed for automated and programmed operation and functionality. For example, the driver can be electrically coupled to an electronic control unit (ECU) that sends command signals to the driver for directing operation thereof, including turning the motor 576 on and off, and engaging and disengaging the clutch 578. The ECU can include a programmable and readable medium for storing and executing different workout routines. The command signals sent by the ECU are based in part upon input at a human-machine-interface (HMI). The HMI could, for example, allow the user to select the different workout routines, turn automated operation on and off, turn manual operation on and off, and stop operation of the exercise apparatus in the midst of a workout routine. Furthermore, in different examples the HMI could be equipped with voice-interaction capabilities and could be a hand-held remote with blue-tooth capabilities. Different sensors could be provided and could electrically communicate with the ECU. For example, a rotary encoder could be operatively associated with the leg holder 566 to sense and communicate the angular position of the leg holder during and after operation. Also, a sensor could be operatively associated with the waist support 516 to sense and monitor when a user's weight bears against the waist support.

As described and shown, numerous embodiments of an exercise apparatus are possible. Each of the embodiments has its own design, construction, and submembers. It should be appreciated that different designs, constructions, and submembers of the embodiments can be incorporated into and combined with one another; for example, the leg brace 314 of FIG. 6 could be incorporated into the exercise apparatus 10 of FIG. 1, and the motorized leg brace 514 of FIG. 11 could be incorporated into the exercise apparatus 110 of FIG. 3 whereby both of the waist support and leg brace provide motor-assisted movement to the user. The different designs, constructions, and submembers are not necessarily exclusive and limited to the embodiment in which they were presented in the figures and in this description.

It is to be understood that the foregoing description is of one or more preferred exemplary embodiments of the invention. Accordingly, the invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and appended claims, the terms "for example," "for instance," and "such as," and the verbs "comprising," "having," "including," and their other verb forms, when used in conjunction with a listing of one or more components or other items, are each to be construed as open-ended, meaning that that the listing is not to be considered as excluding other, additional components or items. Terms of degree such as "about," "generally," and "approximately" include not only the specified dimension or other number, but also variations that do not have a substantial impact on the characteristics or application of that to which the number relates. Other terms are to be construed using their broadest reasonable meaning unless they are used in a context that requires a different interpretation.

The invention claimed is:

1. An exercise apparatus, comprising:

a framework that includes a first side frame and a second side frame;

a waist support connected to said first and second side frames and extending from said first side frame to said second side frame to thereby support a user between said side frames in a horizontal position relative to a ground surface upon which the framework is situated such that the user may be suspended by the waist support in the horizontal position above the ground surface along a longitudinal axis that is generally parallel to the ground surface;

said waist support including at least one movable element permitting the user to rotate about the longitudinal axis relative to the first and second side frames, wherein said at least one movable element comprises a belt looped at said first and second side frames;

a leg brace connected to said framework and being spaced from said waist support along the longitudinal axis, said leg brace being configured such that, when the user is supported by the waist support in the horizontal position with the user's legs passing under the leg brace, the leg brace engages the user's legs at a location on the user's legs opposite the ground surface to thereby prevent upward movement of the user's legs; and at least one drive mechanism operatively connected to at least one of said leg brace or said waist support, wherein, upon actuation of said at least one drive mechanism, said at least one drive mechanism transmits movement to said at least one of said leg brace or said waist support, and the movement is transferred to the user via said at least one of said leg brace or said waist support, and the user's body is turned to different exercise positions.

2. An exercise apparatus as defined in claim 1, wherein said leg brace includes said at least one drive mechanism, and said leg brace includes a leg holder, wherein, upon actuation of said at least one drive mechanism, said at least one drive mechanism rotates said leg holder via a shaft and the rotation is transferred to the user and the user's body is turned to different exercise positions.

3. An exercise apparatus as defined in claim 2, wherein said at least one drive mechanism includes a motor, a clutch, and a gear assembly operatively connected to one another and operatively connected to said leg holder via said shaft.

4. An exercise apparatus as defined in claim 1, wherein said waist support includes said at least one drive mechanism interconnected with said belt, wherein, upon actuation of said at least one drive mechanism, said at least one drive mechanism transmits movement to said waist support belt and the user's body is turned to different exercise positions.

5. An exercise apparatus, comprising:

a framework having a first side frame and a second side frame located on an opposite side of said framework with respect to said first side frame;

a waist support including a belt and at least one drive mechanism, said belt looped at said first and second side frames and extending laterally between said first and second side frames to thereby support a user between said side frames in a horizontal position relative to a ground surface upon which the framework is situated such that the user may be suspended by the waist support in the horizontal position above the ground surface along a longitudinal axis that is generally parallel to the ground surface, and said at least one drive mechanism interconnected with said belt in order to transmit movement to said belt when said at least one drive mechanism is actuated; and a leg brace connected to said framework and being spaced from said waist support along the longitudinal axis, said leg brace being configured such that, when the user is supported by the waist support in the horizontal position with the user's legs passing under the leg brace, the leg brace engages the user's legs at a location on the user's legs opposite the ground surface to thereby prevent upward movement of the user's legs;

wherein, in use, the user is supported in the horizontal position only by engagement of the user's lower torso and legs with the exercise apparatus such that the user can rotate about the longitudinal axis without support of the user's upper torso by the exercise apparatus.

6. An exercise apparatus as defined in claim 5, wherein said framework includes a base frame located against an underlying ground surface, said leg brace connected to said base frame, and said first and second side frames connected to said base frame and extending vertically from said base frame.

7. An exercise apparatus as defined in claim 5, wherein said leg brace includes a rigid member and a plurality of bearings carried by said rigid member and positioned to make contact with the legs of the user when the legs bear against said leg brace, said plurality of bearings facilitating movement of the legs when movement is transferred to the user via said belt.

8. An exercise apparatus as defined in claim 5, wherein said leg brace includes an endless belt located around said framework and extending laterally across said framework.

9. An exercise apparatus as defined in claim 5, wherein said belt of said waist support is an endless belt.

10. An exercise apparatus as defined in claim 5, wherein said waist support includes at least one idle roller, said at least one idle roller supporting said endless belt and facilitating movement of said endless belt when said at least one drive mechanism transmits movement to said endless belt.

11. An exercise apparatus as defined in claim 10, wherein said at least one idle roller includes a first idle roller and a second idle roller, said first idle roller connected to said first side frame of said framework, said second idle roller connected to said second side frame of said framework, said endless belt traversing laterally across said framework between said first and second idle rollers and traversing along at least a part of the vertical extent of said first side frame, along at least a part of the lateral extent of a base frame of said framework, and along at least a part of the vertical extent of said second side frame.

12. An exercise apparatus as defined in claim 5, further comprising:

an electronic control unit (ECU) electrically coupled to said at least one drive mechanism and selectively directing operation of said at least one drive mechanism; and a human-machine-interface (HMI) electrically coupled to said ECU and receiving input from the user.

13. An exercise apparatus, comprising:

a framework having a first side frame and a second side frame located on an opposite side of said framework with respect to said first side frame;

a leg brace connected to said framework; and a waist support connected to said framework and located longitudinally away from said leg brace, said waist support including a first roller, a second roller, and an endless belt, said first roller connected to said first side frame, said second roller connected to said second side frame, and said endless belt looped around said first and second rollers and traversing laterally across said framework between said first and second side frames such that a user may be supported by said belt between said side frames in a horizontal position relative to a around surface upon which the framework is situated;

wherein said belt has a width such that, when in use, said belt engages the user only at the user's waist section; and wherein, in at least one exercise position, a backside of the user's legs bears against said leg brace and a frontside of the user's waist bears against said endless belt, and in this position a frontside of the user's body is generally directed toward the ground surface.

14. An exercise apparatus as defined in claim 13, wherein said framework includes a plurality of frame members constructed for configuring the exercise apparatus between an uncollapsed configuration in which the exercise apparatus can be used, and a collapsed configuration in which the exercise apparatus can be stored during non-use.

15. An exercise apparatus as defined in claim 13, wherein said waist support further includes at least one drive mechanism interconnected with said endless belt in order to transmit movement to said endless belt when said at least one drive mechanism is actuated.

* * * * *